US005647118A

United States Patent [19]

Laperriere et al.

[11] Patent Number: 5,647,118

[45] Date of Patent: Jul. 15, 1997

[54] APPARATUS FOR AUTOMATICALLY ATTACHING ITEMS TO HANG STRIP

[75] Inventors: Robert E. Laperriere, Watertown, Conn.; Michel Louis Armand G. Lequeux, Wellin, Belgium; Richard W. Price, Avon, Conn.

[73] Assignee: North American Plastic Manufacturing Company, Middlebury, Conn.

[21] Appl. No.: 516,427

[22] Filed: Aug. 17, 1995

[51] Int. Cl.[6] ..... B23P 21/00

[52] U.S. Cl. ..... 29/715; 29/714; 29/782; 29/818; 226/18

[58] Field of Search ..... 29/650, 701, 709, 29/714, 715, 779, 782, 818, 241; 226/10, 15, 18, 24, 35

[56] References Cited

U.S. PATENT DOCUMENTS

| | | | |
|---|---|---|---|
| 2,908,908 | 10/1959 | Steinmetz et al. | 29/818 X |
| 3,390,567 | 7/1968 | Frastaci | 29/782 X |
| 5,285,567 | 2/1994 | Thuswaldner | 29/818 X |
| 5,511,920 | 4/1996 | Artrip | 29/818 X |

OTHER PUBLICATIONS

Advertisement in Pop & Sign Design Magazine, Jan./Feb. 1996.

Automatic Application of Our Products Apr. 1994.

*Primary Examiner*—Timothy V. Eley

*Attorney, Agent, or Firm*—Perman & Green, LLP

[57] ABSTRACT

An apparatus for automatically opening interdigitated tab fingers formed on a hang strip provides a base onto which an indexing station, a cutting station and an article attachment station are disposed. A supply of hang strip material is provided and is mounted to the base and is fed through the indexing station and across the cutting station and is guided through to an item attachment end of the base. At the item attachment end the otherwise interdigitated tab fingers are open and the item to be hung is placed onto the upwardly extended one(s) of the finger tabs and are caused to be closed upon themselves upon the continued advancement of the material through the attachment end of the base.

19 Claims, 13 Drawing Sheets

APPARATUS FOR AUTOMATICALLY ATTACHING ITEMS TO HANG STRIP

BACKGROUND OF THE INVENTION

The present invention relates to an apparatus for releasably attaching articles to a web, and deals more particularly with a device for attaching items arranged along a strip with formed tabs to which the items are readily hung for sale to consumers in a store or a like sales establishment.

Items which are sold at retail or wholesale are usually not fully saleable until mounted onto a display or rack. Such displays or racks are usually necessary in order to present the product in the most appealable manner possible. Also, these structures efficiently use valuable floor and shelf space. Items which are not systematically arranged in this way tend to lose their marketability, especially with products whose sales rely on impulse buying at the point of sale location. Also, items, such as photofilm, batteries, utensils, baby products, snack foods and toys are often displayed on such racks. The packaging for these products and many other products include pre-formed slots or circular openings which are cut into the packaging of the product which allow the product to be hung on existing display structures within the retail or wholesale establishment. The problem associated with such display devices is that they require the retail or wholesale establishment to employ individuals to stock items which are shipped as separate individual pieces, and thereafter need to be rendered marketable by displaying them in a uniform manner. As such, standard stocking practices require manual placement of each item onto a rack. This practice tends to be costly. In an attempt to reduce the need to stock each item onto a rack, manufacturers, distributors and the like have attempted to prepackage the items so that they are shipped attached along strips which can readily be hung at the store. In this way, only the strips need be hung. Since each strip may carry between 10 to 20 items, the demand on the store personnel for stocking is reduced by this order as well. The strips used are web-like plastic material which have punched interdigitated tab members disposed along the length thereof and effect hooking of the packaging material through one of the openings or slots formed therein so that the items can be hung in a serial manner along the strip. However, the placing of items onto the tabs of the strips while not the responsibility of the seller of the product, can require equal manpower demands in the loading of individual items to the strips. This is because the tabs punched on the webs are normally closed unto themselves and exist coextensive with the remaining web material so that the user who is responsible for attaching the items with the web, must cause the tabs to be opened in order that the web receive the involved items. Often, it is desired that the strips contain a given number of items so that the items may be displayed uniformly on a rack or the like. This means that after a given number of items are attached to the strip, the strip must thereafter be cut and the items together thus packed as a single unit.

Accordingly, it is an object of the present invention to provide an apparatus which is capable of receiving a hang-strip web in which is contained a plurality of successively oriented hang tabs which, through the intermediary of the operation of the apparatus, are caused to be opened and permit an item to be inserted within the opening of the otherwise closed interdigitated tabs.

It is a further object of the invention to provide an apparatus of the aforementioned type wherein a given number of items can be successively attached to a hang-strip web and thereafter the web is automatically cut to a specific item length with the given number of items remaining attached to the cut length of the hang strip web.

Still a further object of the invention is to provide an apparatus of the aforementioned type whereby strips which provide single or double tabs can be used to mount items to either a single tab or a double tab attachment point on the web.

Further objects and advantages of the invention will become apparent from the following description and the appended claims.

SUMMARY OF THE INVENTION

It has now been found that the foregoing related objects may be readily attained in an apparatus for releasably attaching items to a hang strip comprising a base, an item attachment station located on the base, a means for providing a supply of hang strip material to the article attaching station, an indexing station provided on the base for advancing a hang strip in discreet incremental sections from the means for providing a supply of hang strip material to the article attaching station. The indexing station includes an indexing means having means for engaging formed cut shapes in a hang strip and advancing a hang strip through engagement with an involved one of the formed cut shapes through a location generally adjacent the article attaching station means. Means are provided and associated with the item attaching station for causing selected ones of the formed cut shapes which are otherwise closed to be opened. Means for cutting a hang strip transversely of its length is provided and disposed on the base and wherein the indexing means includes at least one drive member which is driven between first and second positions disposed relative to the base, and the distance separating the first and second positions corresponding to the distance or a multiple of the distance between consecutively ordered formed cut shapes taken along the length of the hang strip.

Preferably, the base includes a cut-out formed therein and the indexing station and item attaching stations are located on a mounting block having a base support surface which is received within the cut-out formed in the base and secured thereto. The article attachment station is located at the free end of the mounting block and the mounting block at the free end thereof has means for constraining and redirecting the path of the hang strip about a right angle turn from an otherwise horizontal path to one that is vertically directed. The cutting means has means for automatically raising a part of the formed cut shapes at the item attachment station. The means for redirecting the path of the hang strip about the free end of the mounting block also includes a chamfered surface provided by the leading edge of the mounting block.

Ideally, adjacent the leading edge of the mounting block and intermediate of the means for redirecting the path of the hang strip is a vertical actuator having a vertically movable member movable between a first lowered position and a second upper position with the lowered position being such that the tip of the vertically movable member is disposed below the base support surface of the mounting block, and the second upper position is disposed substantially above the base support surface of the mounting block and is located coincidentally with a part of an involved one of the formed cutouts to move same to an opened condition. The indexing means includes an actuator having one end secured to the base and having a slidable rod movable between a first position corresponding to the retracted condition of the actuator and a second position corresponding to the extended condition of the actuator, and the actuator free end has a replaceable connecting member which amounts the at least one drive member to the actuator for movement between the first and second positions.

A transversely extending pivot pin may extend transversely of the at least one drive member and the mounting block included a slot extending in the direction of material flow and of a width for receiving the width the at least one drive or pawl member. At least one drive member is being rotatably biased about the pivot pin by a tensioning spring connected between the at least one drive member and the connecting member so as to cause the tip of the pawl to extend upwardly beyond the mounting block support surface, and the position of the tip of the at least one drive member being located above the support surface of the mounting block through the intermediary of a locating pin which contacts the undersurface of the mounting block and yieldably positions the at least one drive member thereat under the bias of the tensioning spring.

Preferably, the supply means includes a supply roll mounted to a column vertically disposed on the base, the column having a transversely extending mounting pin threaded at one end thereof and secured to the column at the other end thereof, a clamping bar has a through opening formed therein appropriately sized and shaped to receive the mounting bolt, a supply roll bearing member is mounted to the column and bears upon the inner surface of the supply roll, and tensioning means associated with the supply roll for tensioning the payout of the hang strip from the roll as the hang strip is advanced by the indexing means. The index means is controlled by a counting means which records the number of successive indexes that are effectuated by the indexing means and causes the cutting means to cut the hang strip transversely of its length at a point corresponding to where along the length of the strip a given number of indexing operations have occurred.

The apparatus for releasably attaching items to a hang strip also includes sensing means associated with the indexing station for sensing the occurrence of an indexing operation and causing a lifting means associated with the item attaching station to be activated in response to the articulation of the indexing means. Control means is associated with the sensing means and the indexing means for prompting the index means to advance the hang strip a given incremental distance and for counting the number of successive indexing operations occurring along the length of the hang strip and for causing the energization of the cutting means to cause the hang strip to be cut transversely of its length after a predetermined number of advances has occurred.

DETAILED DESCRIPTION OF THE PREFERRED EMBODIMENTS

Figure 1:
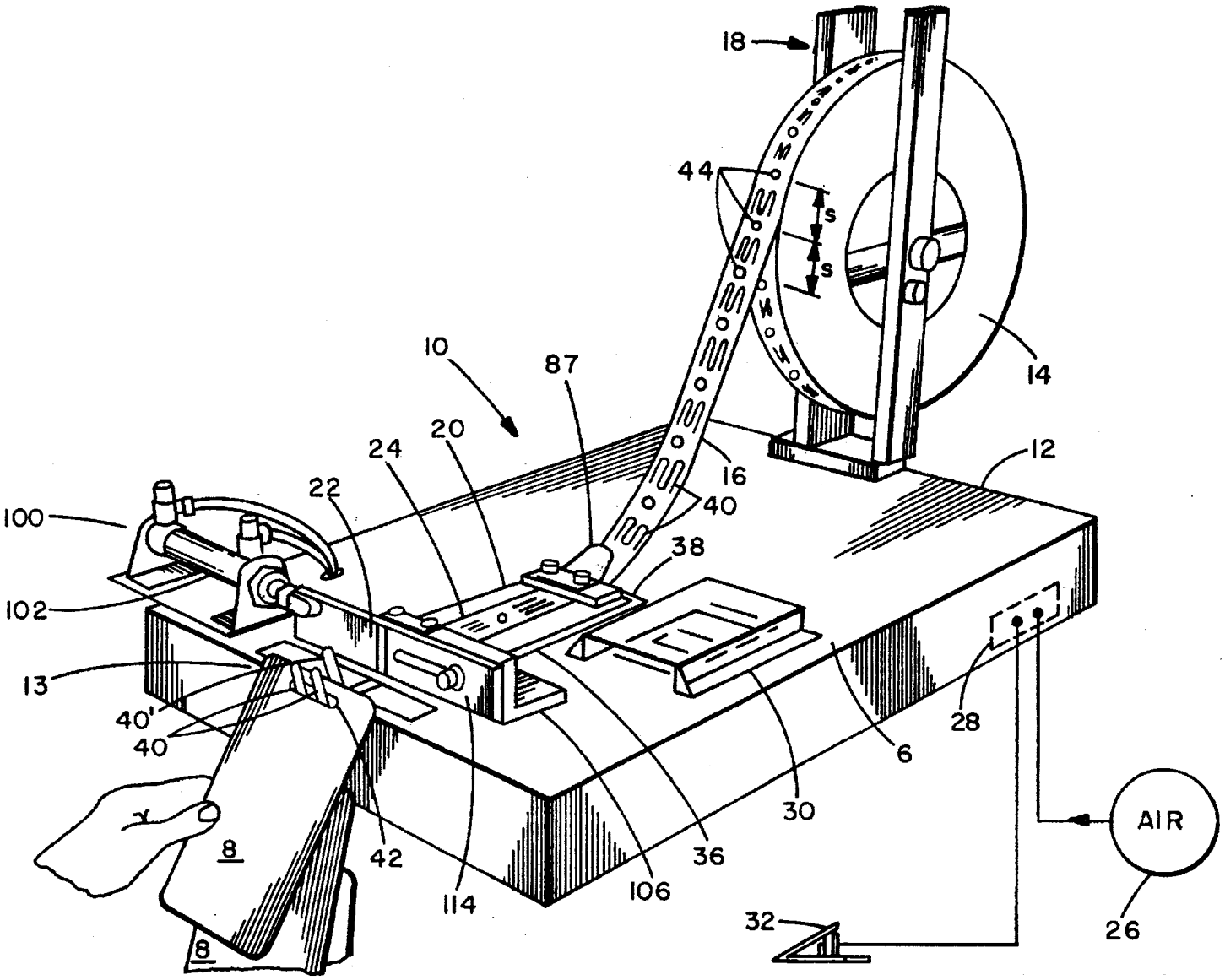
FIG. 1 is a perspective view of the apparatus of the invention shown with a supply roll of hang strip material located at one end thereof.
Figure 2:
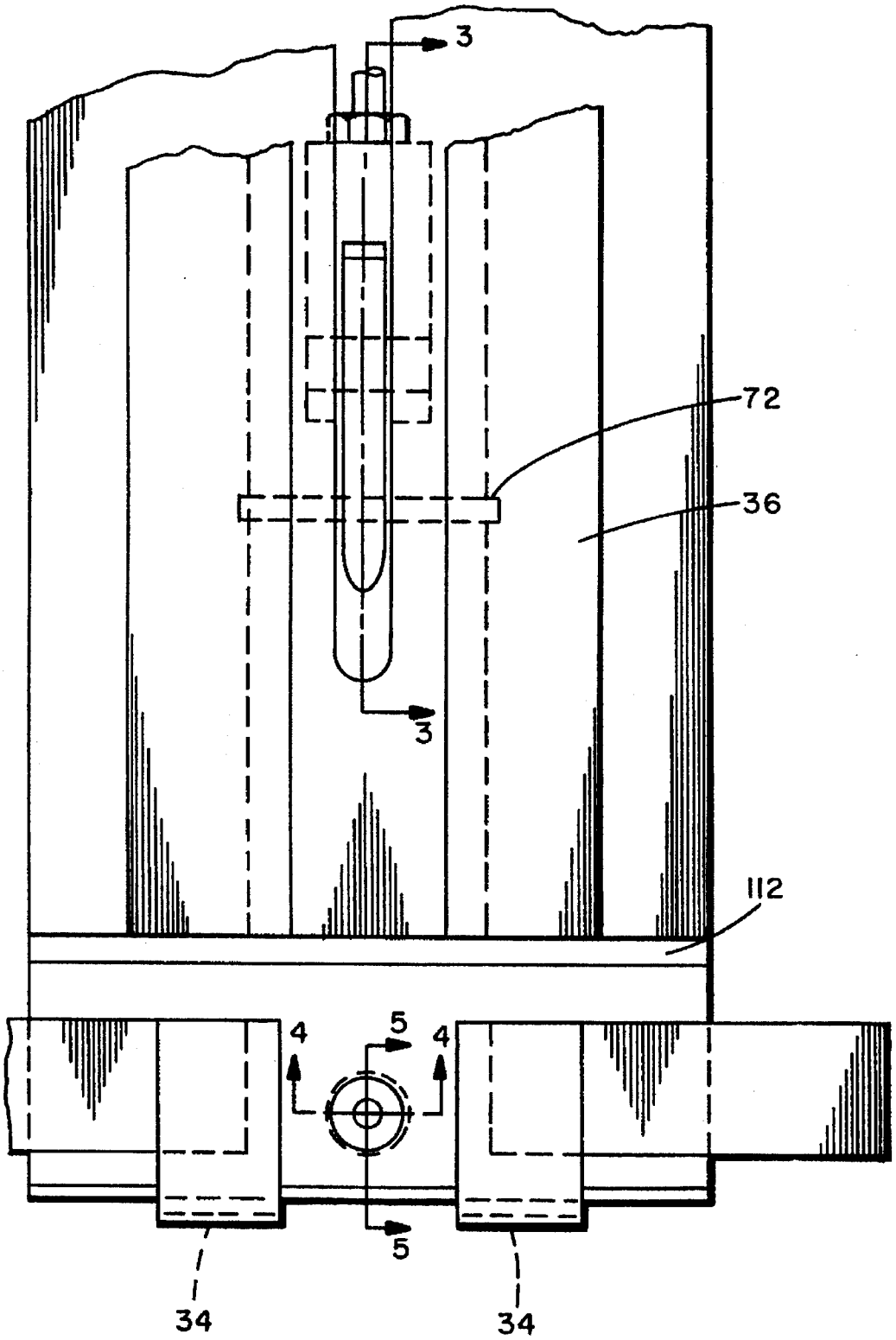
FIG. 2 is a partially fragmentary plan view of a first embodiment of an indexing station of the apparatus in which is used a single pawl mounting block.
Figure 4:
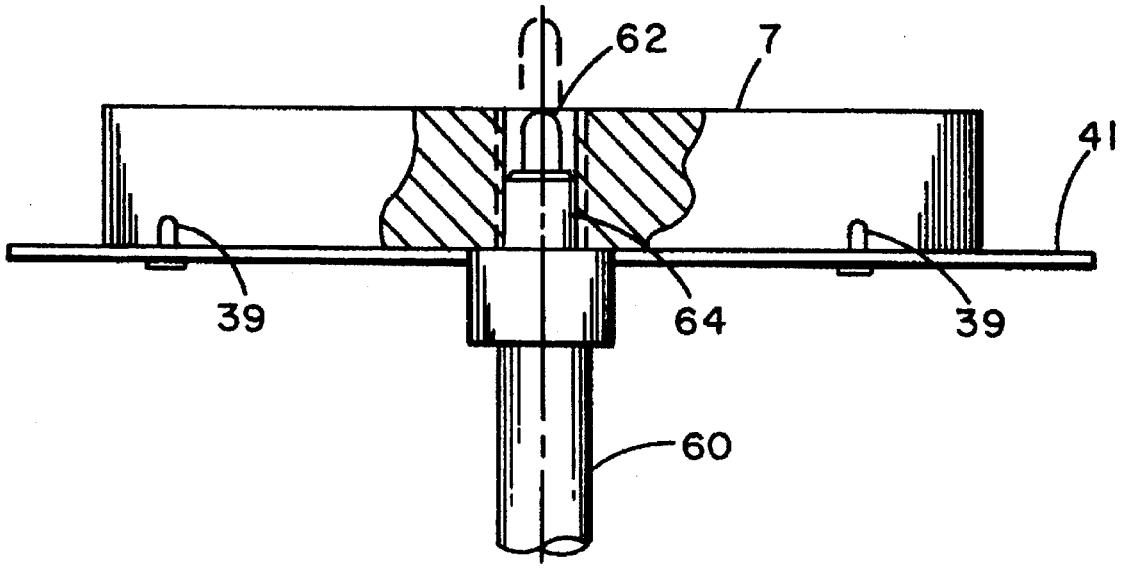
FIG. 4 is a partially fragmentary sectional view taken along line 4—4 of FIG. 2.

FIG. 1 illustrates the apparatus of the invention shown generally by the numeral 10. The apparatus includes a base 12 having an upper surface 6 to which is mounted a supply roll 14 of a continuous hang strip web 16 which is rotatably mounted in roll form on a supply tower 18 which is in turn mounted at one end of the base 12. The apparatus 10 further includes an indexing station 20 through which is passed the hang strip 16, an article or item attachment station 13 disposed at one end of the base 12 for effecting attachment of the items or articles 8,8 to the web 16, and a cutting station 22 disposed downstream of the indexing station 20 and is provided for the purpose of causing the hang strip to be cut laterally of its length at a point coincident with the location of the cutting station. The indexing station 22 is responsible for the advancement of the hang strip 16 from the supply roll 14 to the item attachment station 13 and this occurs through the intermediary of indexing means 24 located at and provided as part of the indexing station 20. The indexing means 24 is driven by a pneumatic drive system provided with a pressurized air supply 26 and a control means 28 which includes a counter means 30 and a foot pedal switch 32 which together are responsible for advancing the hang strip 16 incrementally before causing cutting of the hang strip at the cutting station 22. As best illustrated in FIGS. 2 and 4, the front end of the base 12 at the attachment station 13 includes downwardly directed elbow guides 34,34 disposed on opposite sides of the path followed by the hang strip through the indexing station 20. The guides 34,34 function to redirect the hang strip from an otherwise horizontal direction to one that is vertically disposed. As will be discussed in greater detail later, the transition between horizontal and vertical directions is important to causing the hang strip to open and to allow a given one of the involved items 8,8 to be secured to the strip.

Figure 3:
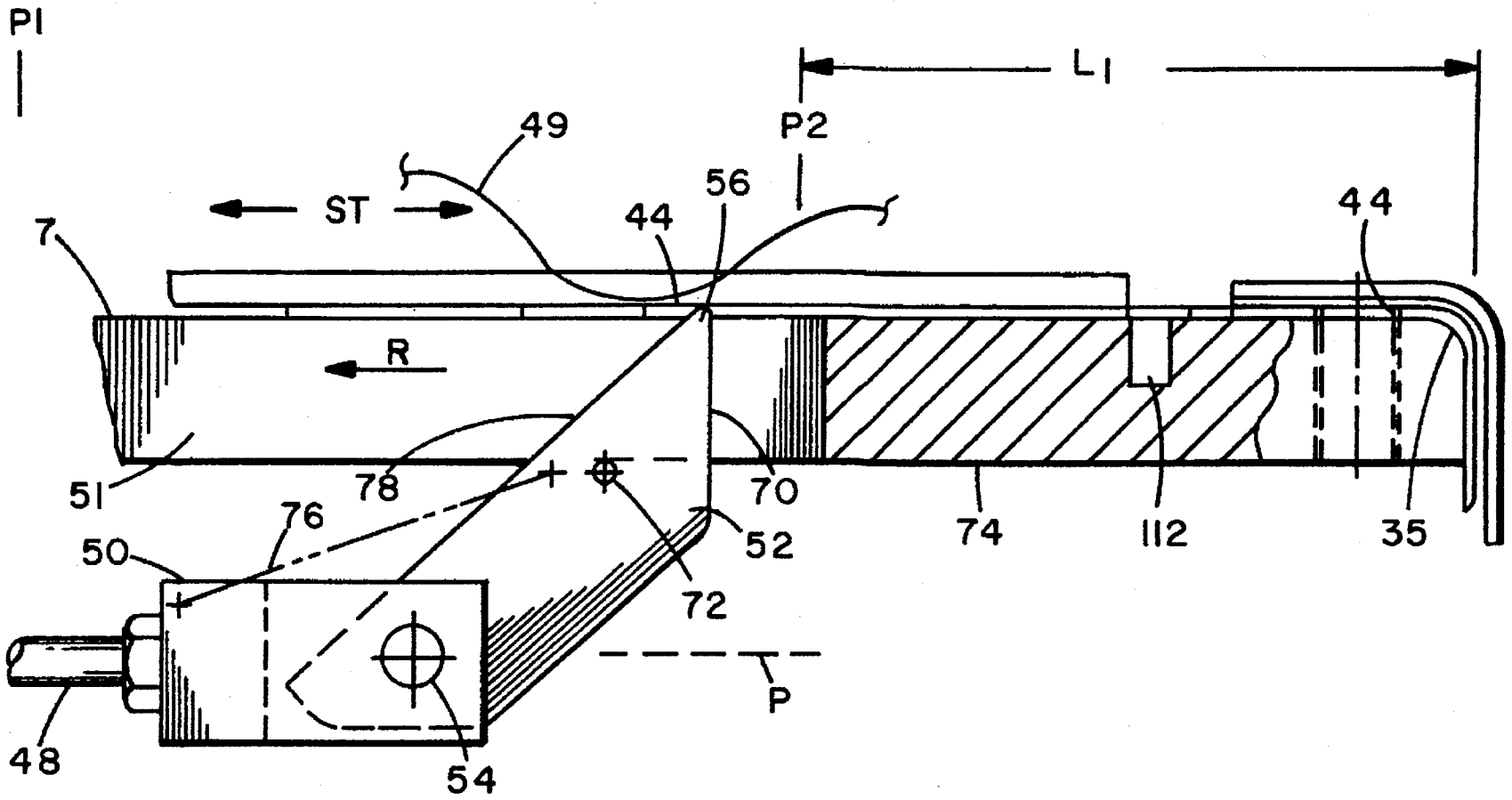
FIG. 3 is a vertical sectional view taken along line 3—3 in FIG. 2.
Figure 7:
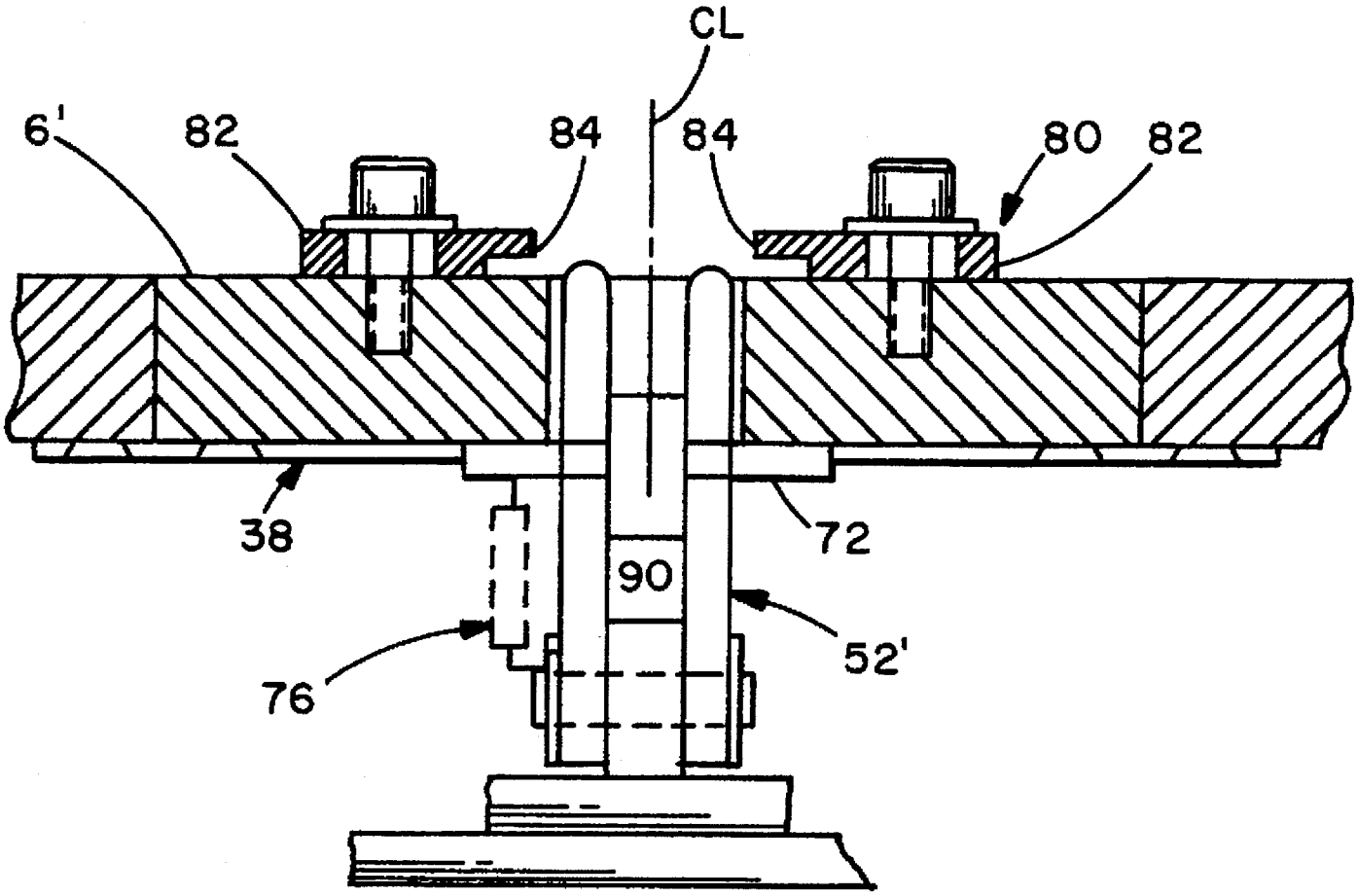
FIG. 7 is a partial fragmentary vertical section taken along line 7—7 in FIG. 6.

Turning now to FIGS. 2–4, and in particular to the indexing means 24 located at the station 20, it should be seen that the indexing means 24 is provided on a base mounting block 36 having a material support surface 7 which is separately detachable from the base 12 and is normally received within a corresponding cut-out 38 formed in the base 12 of the apparatus 10. For purposes of clarity of discussion, the base mounting blocks are referenced either as 36 or 36' because, a feature of the invention provides for two blocks which are interchangeable with the base depending on the type of tab orientation which is being used for the items The mounting blocks 36, 36', as best illustrated in FIGS. 4 and 7, are connected to the base 12 through the intermediary of underlying mounting plates 41,41 which are connected to the undersurface of the mounting block 36,36' and span the cut-out 38 formed in the base 12 at the front and the-rear ends thereof and are connected to the base along the lateral sides of the cut-out by screws 39,39.

Figure 6:
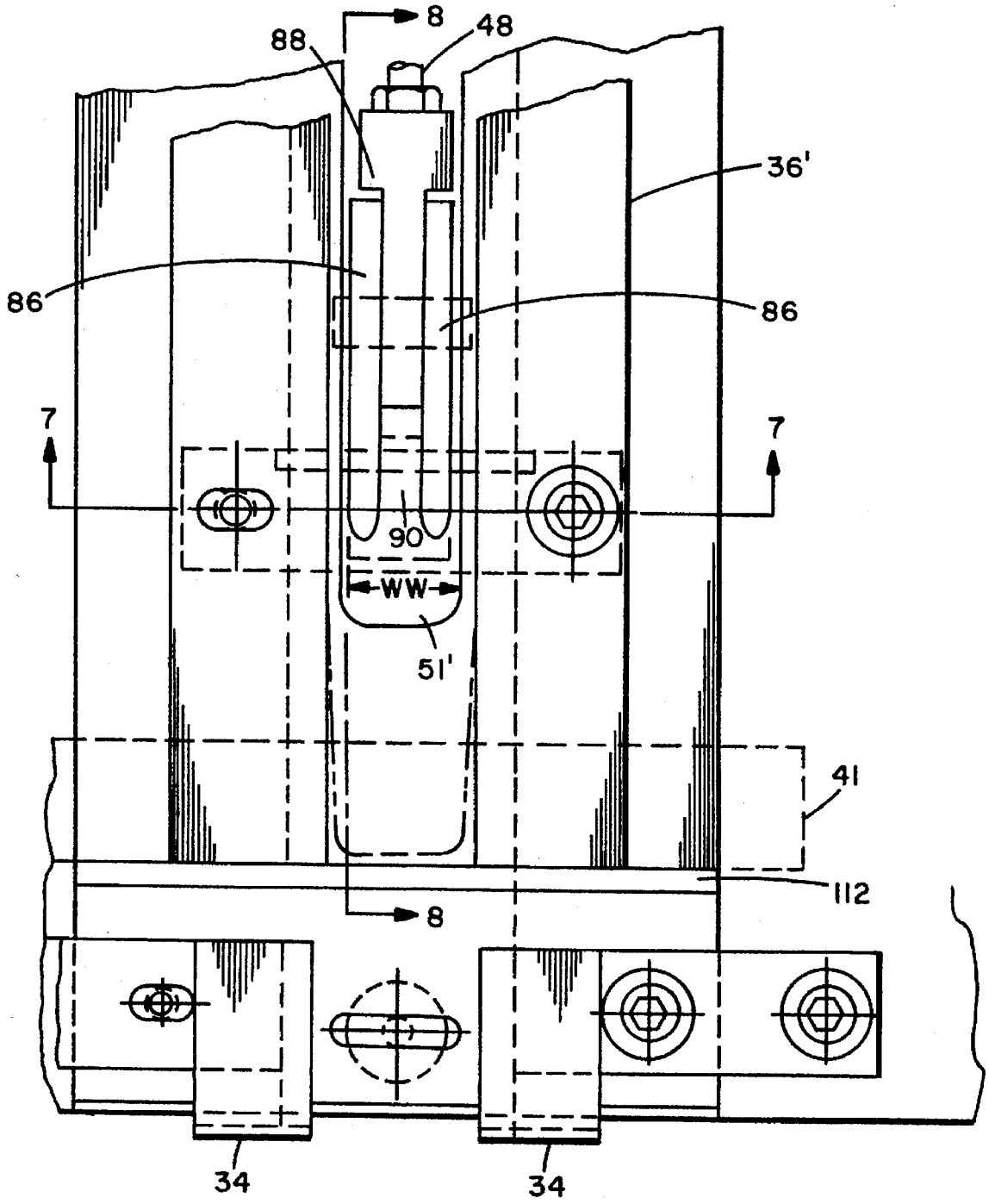
FIG. 6 is a partially fragmentary plan view of a second embodiment of an indexing station of the apparatus in which is used a double pawl mounting block.

As mentioned, each mounting block 36 and 36' is interchangeable with the other within the cut-out 38 to allow either the block shown in FIG. 2 or that shown in FIG. 6 to be assembled within the base in accordance with the type of hanging which is desired. As illustrated in FIG. 1, the hang strip 16 is provided with a series of formed cut shapes or interdigitated finger-like tabs which are disposed along the length of the web at spaced intervals. Each interdigitated set of tabs is comprised of a pair of spaced tabs 40,40 extending in one direction and interdigitated with a single locking tab 40' extending in another opposite direction to define a single attachment point on the strip. As best illustrated in FIG. 1, the items 8,8 have openings 42,42 formed in the packaging which are suitably sized and shaped to receive the spaced pair of tabs 40,40 of each set. These openings, as will be discussed in greater detail later, may vary in size-and in shape, and the system is adaptable to handle such variations. The hang strip 16 includes a plurality of circular openings 44,44 which are disposed along the length of a strip at uniform intervals S,S which correspond to like spacings between the interdigitated finger tabs 40, 40'. As such, the mounting block 6 shown in FIG. 2 is used because the single pawl design is adapted to coact with the openings 44,44. In some cases, the packaging of the items 8,8 may include only a single circular opening which is proportionately sized to receive the single tab 40' of the interdigitated tab set. For this to occur, however, the hang strip 16 web must be reversed wound so that the single tab finger 40' of each interdigitated tab set is directed toward the supply roll 14, as opposed to being directed away from it as illustrated in FIG. 1. In this case, the mounting block of FIG. 6 is used because it is provided with a dual pawl design adapted to coact with the cuts outlining the tab pairs 40,40 formed in the hang strip 16.

Referring now to FIGS. 2 and 3, it should be seen that indexing station shown therein is defined by the mounting block 36 which includes the indexing means 24 having a single pawl design. The indexing means 24 includes a double acting actuator (not shown except schematically in FIG. 16 as element 225) which is secured at one end thereof to the undersurface of the base 12 and has a reciprocating piston rod 48, the free end of which is attached to a clevis member 50 which is movable in a plane P between a first P1 position corresponding to the retracted condition of the actuator, and a second P2 position corresponding to the extended condition of the actuator. Disposed within the clevis 50 is a pivotal pawl member 52 which pivotally connects to the clevis through a pivot pin 54 which is secured to the clevis so as to allow the pawl 52 to rotate thereabout. The pawl 52 is received within a slot 51 formed in the mounting block 36 for movement therealong between the indicated P1 and P2 positions. The piston rod 48 moves through the plane P which extends generally parallel to the support surface 7 of the mounting block and the pawl 46 has an upper tip 56 which extends slightly above the surface 7 and defines the end of travel locations P1 and P2 of the means 24. As previously mentioned, each of the base blocks 36 and 36' includes the elbow guides 34,34 which are disposed along opposite sides of the path followed by the hang strip through the apparatus and cause the path followed by the hang strip to be redirected from an otherwise horizontal direction to a vertical direction. The elbow guides are disposed about the leading edge of the block 36,36' which edge is defined by a chamfered surface 35. The stroke of the actuator means is selected such that it corresponds to the spacings S,S between the circular openings 44,44 formed on the strip. This is important because the tip 56 of the pawl 52 is caused to engage within and involved one of the circular openings 44,44 at the P1 position and thereafter drive the hang strip a distance equal to its stroke length ST to the P2 position whereupon a preceding length of the strip corresponding in length to that which was advanced is driven forwardly around the leading edge 35 of the mounting block through the path created by the elbow guide 34,34.

Figure 5:
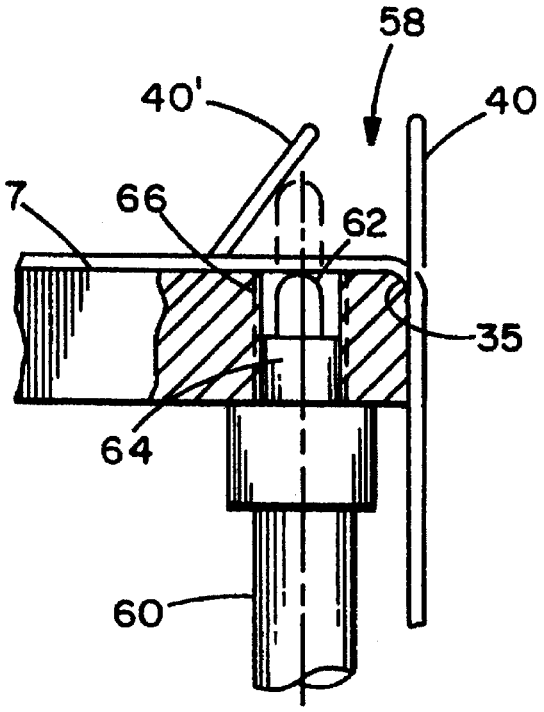
FIG. 5 is a partially fragmentary vertical section view taken along line 5—5 in FIG. 2 of the article attaching end of the apparatus showing the opening operation between interdigitated tabs of the hang strip.

As best illustrated in FIG. 5, the distance L1 extending between the P2 position on the mounting blocks 36,36' and the associated chamfer surface 35 is such that it causes a fold to occur transversely of the interdigitated finger tab pair 40,40, such that the tabs are caused to stand substantially upright by virtue of the redirection of the hang strip about the chamfer surface 35, as the hang strip is constrained by the elbow guides 34,34. Because the single interdigitated tab 40' trails the tab pair 40,40 and remains substantially supported by the mounting block surface 7, it must be mechanically raised in order to provide a space 58 in which the item 8 is received. Accordingly, each of the mounting blocks 36,36' is provided with a vertical actuator 60 having a sliding piston rod 62 which is extendable to the position indicated in phantom line shown in FIGS. 4 and 5 in order to move the single interdigitated tab to its vertically disposed position. The vertical actuator 60 is provided with a narrowed upper portion 64 on which is disposed a threaded cylindrical surface, and which end portion is received within a corresponding threaded opening 66 formed in the mounting blocks 36 and 36'. As illustrated in FIG. 5, the upper end of the vertically sliding rod 62 is configured to take on a generally dome-like shape which is adapted to contact the undersurface of the finger tab 40' after the indexing means 24 advances the hang strip a given incremental distance so that the interdigitated fingered tabs 40,40' are disposed across the chamfered surface 35 of the mounting block 36.

Figure 8:
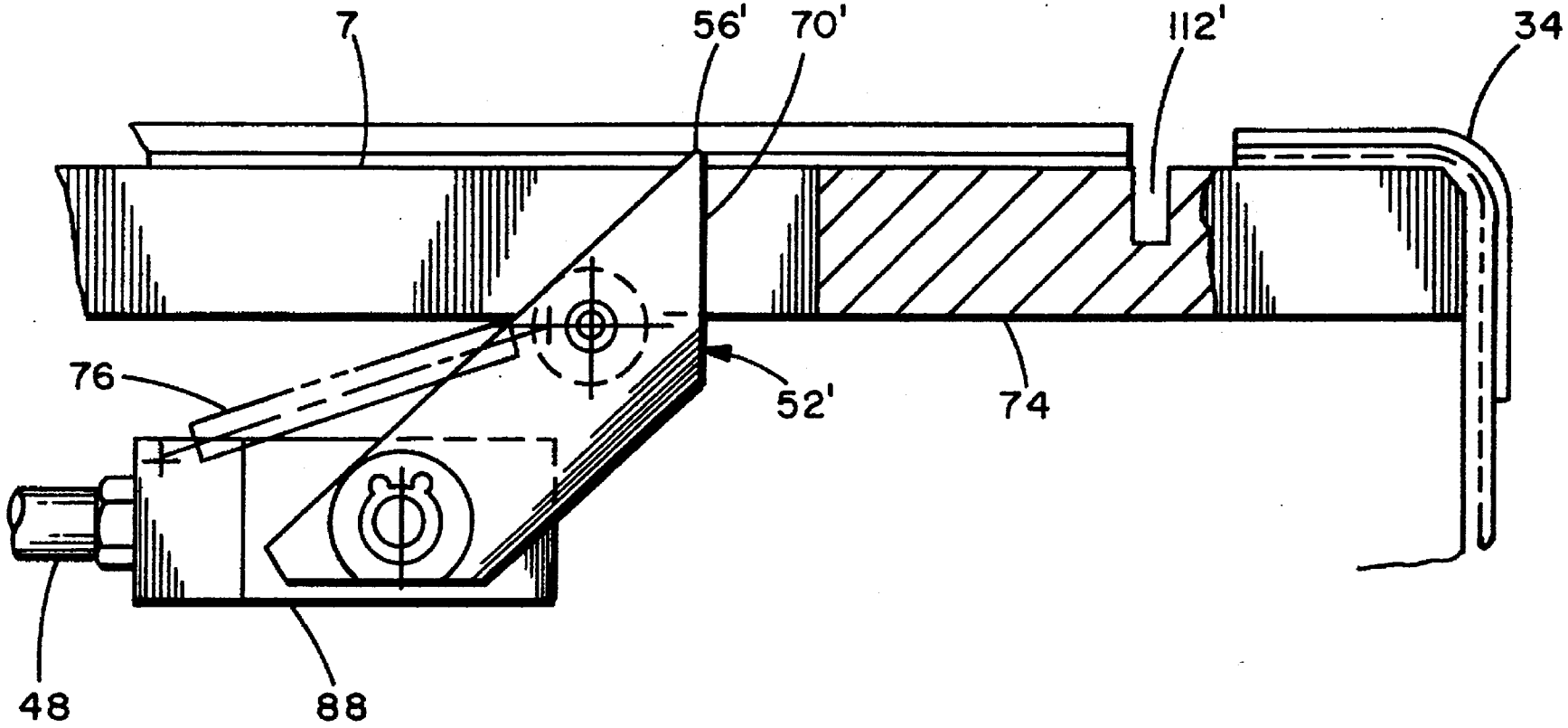
FIG. 8 is a partially fragmentary vertical sectional view taken along line 8—8 in FIG. 6.

As best illustrated in FIGS. 3 and 8, the tip 56,56' of the drive pawl 52,52' is biased upwardly so as to maintain a frontal abutment surface(s) 70,70' in a generally perpendicular disposition relative to the support surface 7 of the mounting block 36,36' so as to be responsible for engaging with and pushing on the opposed surface in the hang strip. To these ends, a locating pin 72 is provided as part of the drive pawl assembly and extends transversely across the slot 51,51' formed in the mounting block 36,36' and is maintained against the undersurface 74 of the mounting block through the intermediary of a tension spring 76 connected at one end to the drive pawl 52,52' and at its other end to the clevis 50 or tongue member 88 as the case may be. In this way, the drive pawl is rotatably biased in a counterclockwise direction so as to yieldably maintain the tip(s) 56,56' of the drive pawl 52 above the support surface 7 of the mounting block 36 while nevertheless allowing the drive pawl 52 to be yieldably rotated in a clockwise direction against the bias of the tensioning spring 76. This is an important feature because it allows the tip(s) 56,56' of the pawl to be located within an involved one of the circular openings 44 formed in the hang strip 16 as in the case of the embodiment of FIG.

3 and to locate the tips of the pawl 52' within the cut outline of the tabs 40',40' formed in the hang strip 16. Once advancement of the involved hang strip section is complete, i.e. the tip of the pawl is located coincidentally with the P2 position, the actuator 225 is then reverse energized and the tip of the drive pawl 52 is moved towards the P1 position. The tension on the spring 76 is such that the tip 56 is driven downwardly by the coaction of the rear sloped surface 78 of the drive pawl 52 when moved in the return direction R against the rear surface of the opening in the strip 16. As previously mentioned, the stroke length of the actuator is such that the movement of the rod in the return direction R positions the pawl tip(s) 56,56' at the P1 position, which is coincident with the position of the next opening in the strip such that automatic registration occurs therebetween. In order to insure that the hang strip 16 remains stationary during this process a downwardly directed leaf spring 49 may be provided to apply a downward load to the hang strip 16 to maintain it against movement.

The hang strip 16 is fed through the indexing station 20 and is maintained in lateral alignment with the drive pawl 52,52' so that the drive pawl is disposed symmetrically with the center line CL of the length of the strip. To these ends, as best illustrated in FIGS. 1, 6 and 7, each mounting block 36 and 36' includes a pair of lateral position guide means 80 which are responsible for engaging with the lateral side edges of the hang strip 16 so as to center it coincidentally with the drive pawl 52,52'. The guide means 80 includes first and second flange members 82,82 each having undercut portions 84,84 which provide recesses between the upper surface 7 of the mounting block 36,36' and the remaining part of the flanges so as to receive the thickness of the hang strip therewithin, with a slight clearance existing therebetween. To assist in the feeding of the hang strip 16 through the indexing station 20, a guide member 87 (see FIG. 1) is provided for this purpose.

Referring now to FIGS. 6 to 11 and to a second alternative embodiment of the indexing means 24, it should be seen that the indexing means 24 is the same as that discussed with reference to the embodiment shown in FIGS. 2–5, except that it is mounted on an interchangeable mounting block 36' and the drive pawl referenced as 52' has a bifurcated shape rather than being formed as a single elongated member. The drive pawl being bifurcated is comprised of a pair of pawl members 86,86 which connect to a tongue member 88 which is in turn releasably connected to the end of the piston rod 48 through the intermediary of a thread connection or the like. The members 86,86 are integrally formed with a body portion 90 which straddles the tongue member 88 and is pivotally connected thereto by a transversely disposed locating pin 72. The tensioning spring 76 connects between the tongue member 88 and the pawl 52' so as to bias the member in the counterclockwise direction in the mariner which has been previously discussed with reference to FIG. 3.

Figure 9:
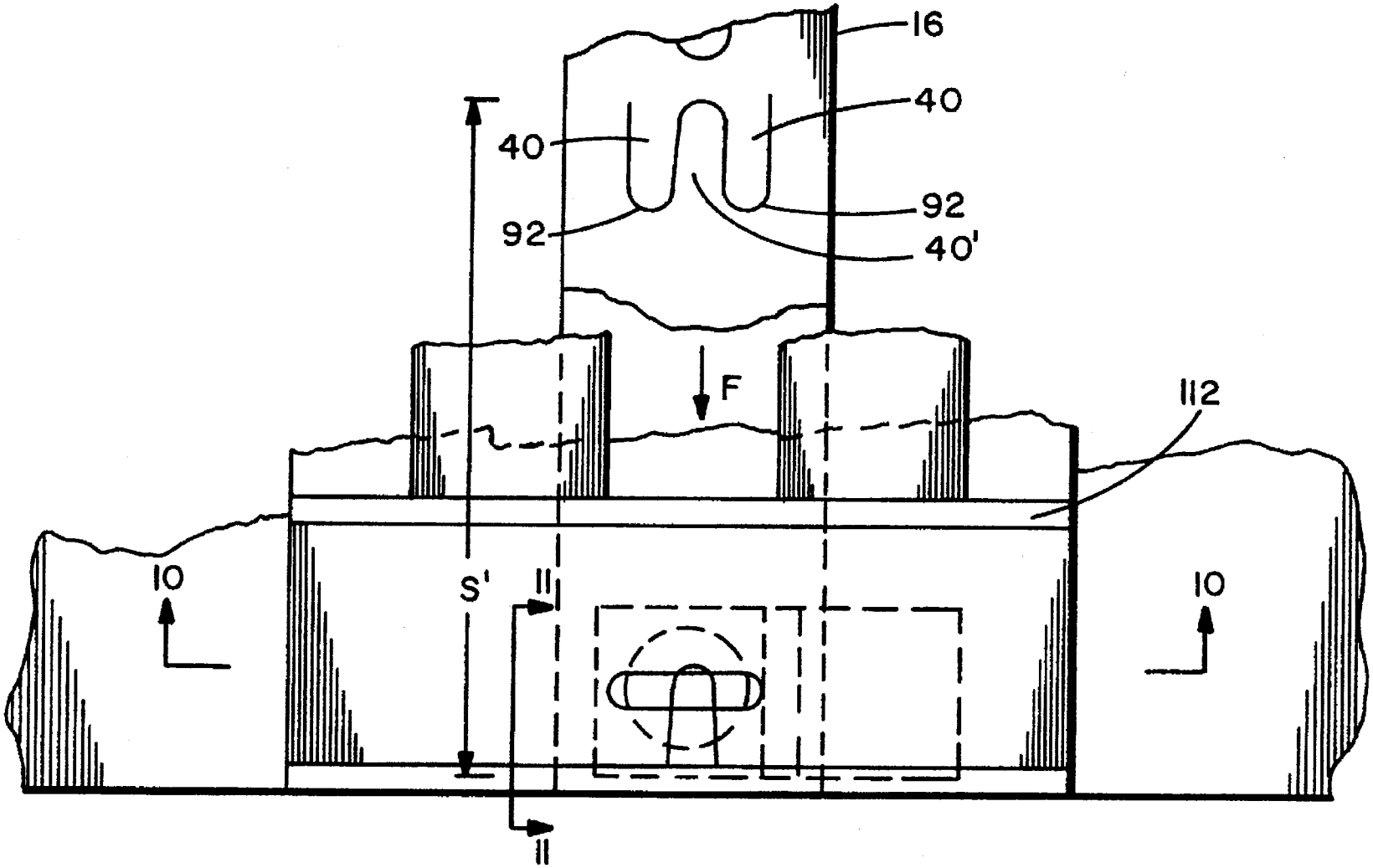
FIG. 9 is a partially fragmentary top plan view of the free end of the interchangeable indexing station of FIG. 6 showing the double pawl mounting block and superior posed hang strip web.
Figure 10:
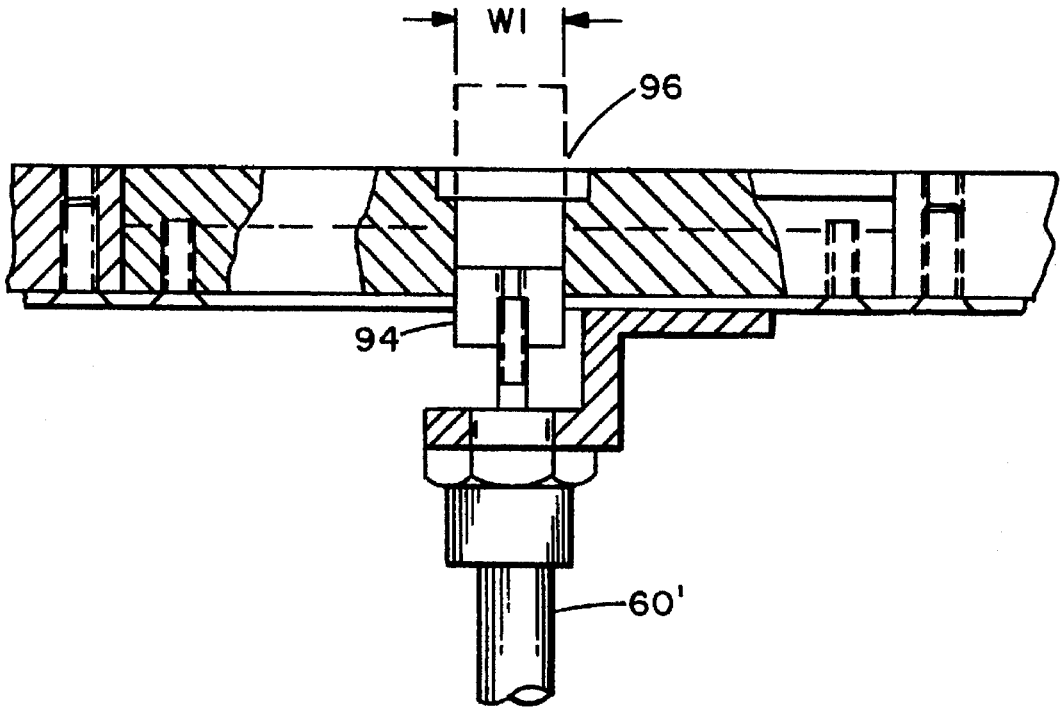
FIG. 10 is a vertical sectional view taken through line 10—10 in FIG. 9.
Figure 11:
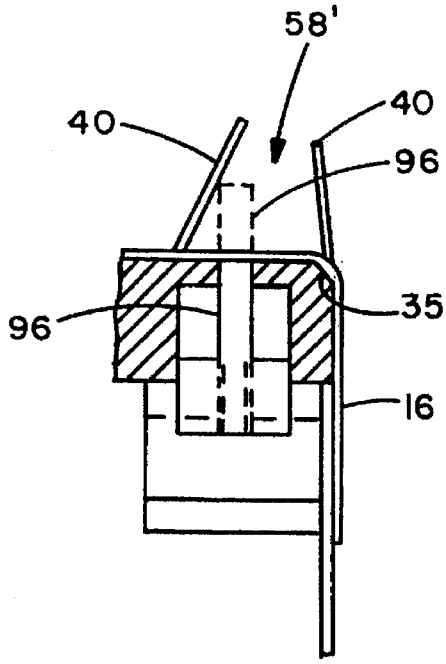
FIG. 11 is a vertical sectional view taken along line 11—11 in FIG. 9 showing the opening operation between interdigitated tabs of the hang strip.

As seen in FIG. 7, the slot 51' formed in the interchangeable base block 36' is appropriately sized to receive the extended width WW of the bifurcated pawl 52'. As illustrated in FIG. 9, the alternate embodiment of the mounting block 36' is adapted to take advantage of the orientation of the tab finger pairs 40,40 when the hang strip 16 is wound in reverse orientation from that which is shown in FIG. 1. As seen therein, the finger tab pairs 40,40 are oriented such that the ends of the double finger tabs 40,40 are pointed in the direction of flow F such that the curved punched or cut outlined portions of the web which define the tips of the finger tabs, 40,40 are engaged by the tips 56',56' of the bifurcated pawl member 52'. Although the interdigitated tabs 40,40 are punched from the plastic sheet material making up the hang strip and normally exist locally in a common plane with the remaining material, the tabs 40,40 are otherwise readily displaced upwardly by the upwardly directed force provided by the tensioning spring 76' as the pawl 56' is returned to its P1 position. The punched curved bottom portions 92,92 of the indexing strip 16 are spaced from like cut-out portions along the length thereof by a distance S',S' which again corresponds to the stroke length of the actuator as discussed previously with reference to FIG. 3. The hang strip 16 is caused to be redirected around the chamfer surface 35 of the leading edge of the mounting block by the elbow guides 34',34' so as to automatically cause the single finger tab 40' to be moved to a generally vertically disposed orientation as illustrated in FIG. 11. In order to effect lifting of the trailing dual finger tab pair 40,40 to create the space 58' therebetween for the item, a vertical actuator 60' is provided and is connected to a sliding plate 94 for vertical movement between an extended and a retracted condition. The sliding plate 94 is sufficiently sized in the W1 direction to span between the dual tab members 40,40, and is journalled within a correspondingly sized and configured opening 96 formed in the mounting block 36' so as to maintain the sliding block in a generally perpendicular orientation relative to the longitudinal extent of the hang strip.

Figure 12:
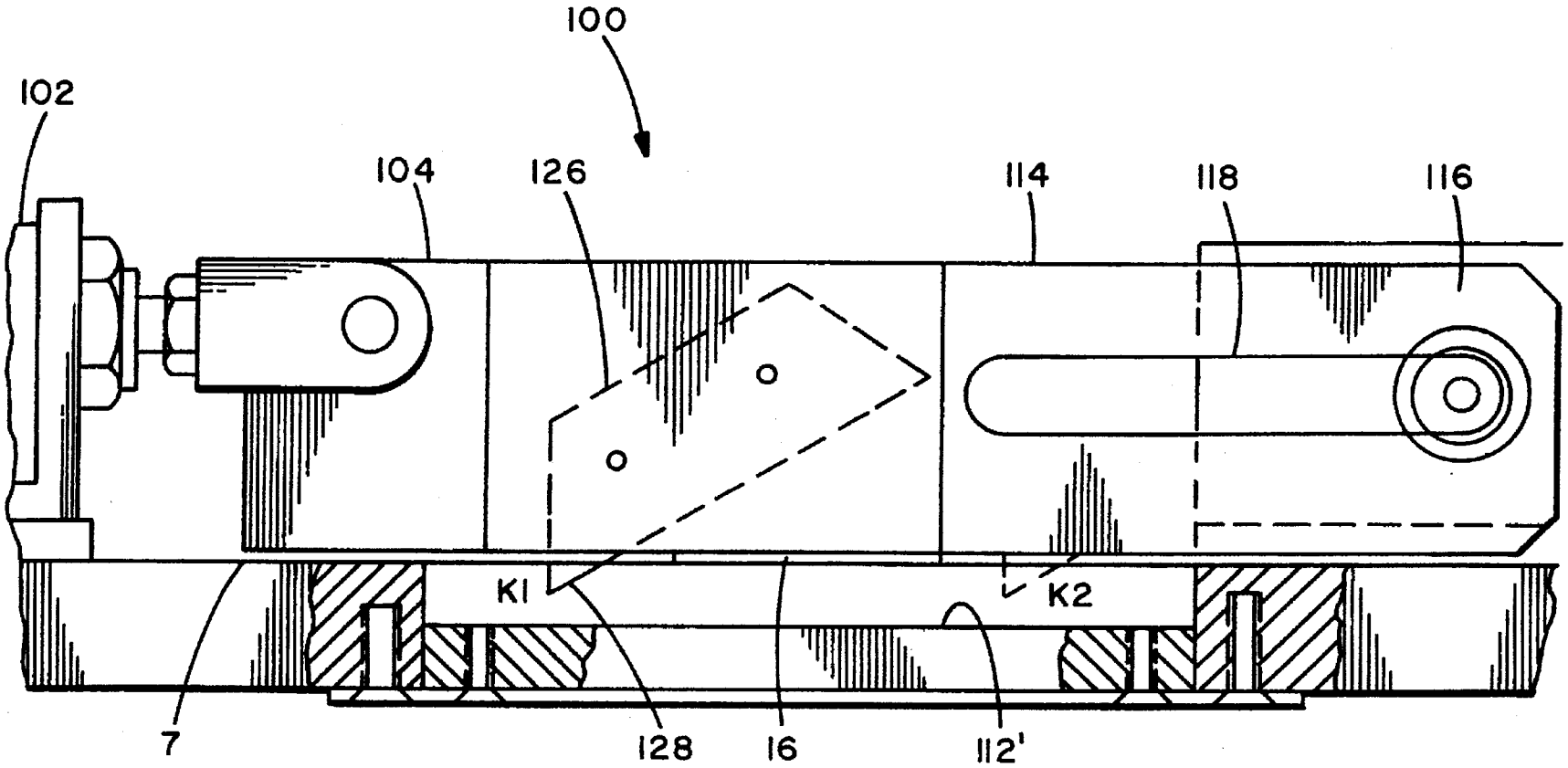
FIG. 12 is a partially fragmentary front elevation view of the hang strip cutting means of the apparatus.
Figure 13:
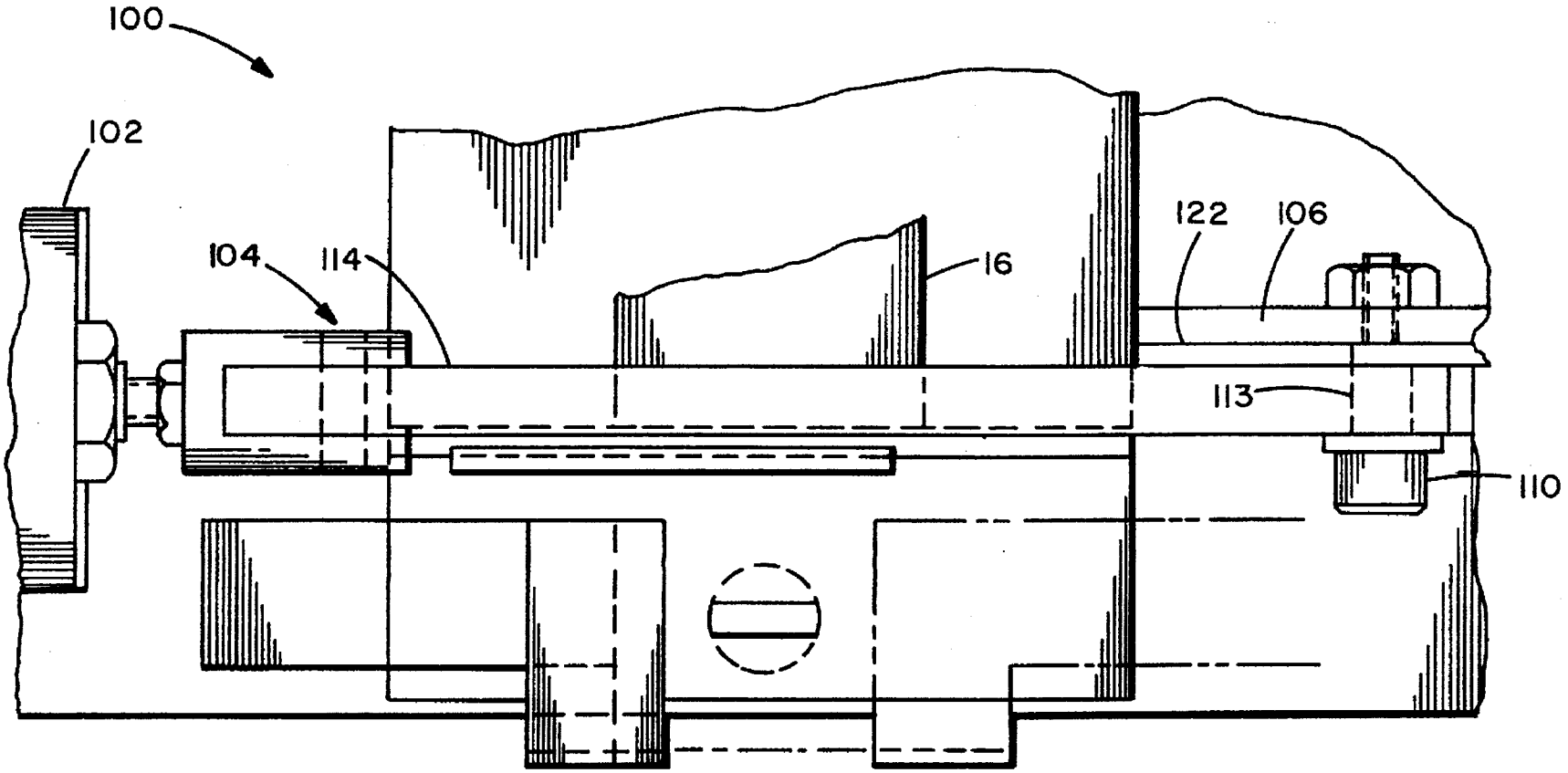
FIG. 13 is a partially fragmentary top plan view of the hang strip cutting means shown in FIG. 12.

Once the involved item 8 is attached to the hang strip at the attachment station 13, the indexing means 24 is again actuated to advance the next interdigitated finger tab pair 40,40 to the attachment station 13. It is a feature of the invention to cut the hang strip at a point along its length between the indexing station and the attachment station 13 after a given number of items have been attached to the strip. To these ends, the apparatus 10 further includes a cutting means 100, disposed generally adjacent the article attachment station 13 and includes a dual acting actuator 102 connected through its piston rod to a knife blade assembly 104 extending transversely across the path of travel of the hang strip 16. The knife blade assembly 104 spans the mounting block receiving cut-out 38 formed in the base 12 and includes an angle member 106 which is secured to the base 12 by an appropriate bolt and nut connection. As seen in FIGS. 3 and 8, each of the interchangeable mounting blocks 36 and 36' has a transversely extending channel 112, 112' formed through the support surface 7 thereof. A slide plate 114 is provided as part of the assembly and is positioned above and coincidentally with the channel 112,112'. The slide plate 114 has an elongated slot 118 formed at one end thereof which is appropriately sized to receive a slide boss member 113 which is maintained in alignment by bolt connection 110 disposed thereabout. A lubrication plate 122 is also provided and is disposed between the slide plate 114 and the bolt connection 110 thereby providing sufficient lubrication between the moving surfaces. A knife 126 is carried by the slide plate and has a depending end 128, as best seen in FIG. 12, which extends below the mounting block support surface 7 and into the channel 112. In the retracted condition of the actuator 102, the knife is maintained out of the path of travel of the hang strip 16 as illustrated in FIG. 12 by the K1 position and is caused to move transversely across the path of travel of the hang strip to the K2 position indicated in phantom line thereby completely severing the plastic material which makes up the hang strip. As part of the control means 28, the knife 126 is returned to its K1 position immediately after making its cutting stroke. In this way, the hang strip is capable of being cut into segments each of a desired length and in accordance with a desired number of the items 8,8 hung on a designated strip length. As will become apparent in greater detail later, the control system of the invention provides for the automatic counting and subsequent cutting of web lengths in accordance with instructions setting forth the number of articles to be attached to a given hang strip segment. It is noted that the counter means 30 is capable of being preset to a given number, which corresponds to a given number of indexing operations which will occur before the cutting means 100 automatically cuts the strip material.

Figure 14:
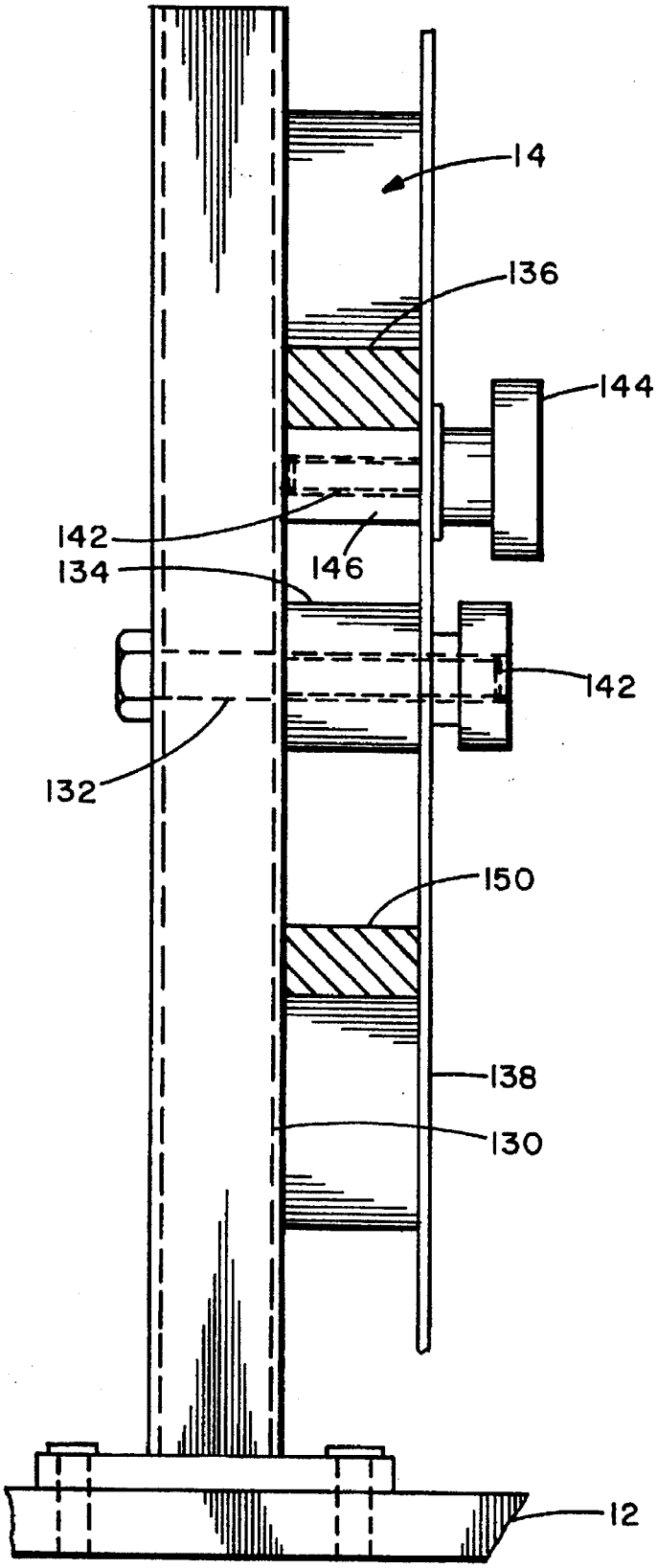
FIG. 14 is a front elevation view of the supply roll tower.
Figure 15:
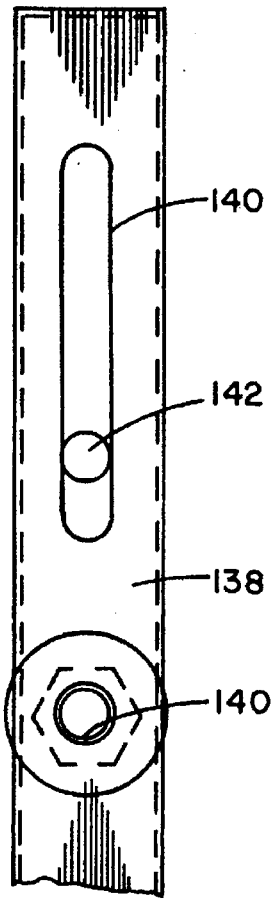
FIG. 15 is a partially fragmentary view of the tensioning device for the hang strip supply roll.

Referring now to FIGS. 14 and 15, and particularly to the supply tower 18 which supports the supply roll 14 of the hang strip material, it should be seen that the supply tower 18 is comprised of a single column 130 which is bolted to the base 12 of the apparatus 10 to maintain it in a generally vertical disposition. Disposed approximately mid-length of the column 130 is a transversely extending mounting bolt 132 which is fixed to the column 130 at one end thereof and extends outwardly in a cantilevered manner to rotatably support the supply roll 14 thereon. As is best illustrated in FIG. 1, a supply roll core holder bar 134 is provided and is mounted on the bolt 132 and extends diametrically across between the inner diametric surface of the core 136 of the supply roll 14 to rotatably mount the roll in the illustrated manner. It should be appreciated that each opposite end of the holder bar 134 has a corresponding curved surface which provides a bearing surface against which the inner surface of the core 136 slidably engages. Also mounted to the bolt 132 is a clamping bar 138 laterally outwardly of the bar 134 and includes an opening 140 formed therein for receiving the bolt 132 therethrough. A locking nut 142 is provided and threadably engages on the outer end of the bolt 132 so as to cause the clamping bar 138 to be clamped against the side edges of the supply roll 14 in the manner illustrated in FIG. 14. As illustrated in FIG. 15, the clamping bar along one end thereof, includes an elongated slot 140 into which is received a correspondingly diametrically sized locking bolt 142 which is rotatably connected to a tightening head 144. A friction cylinder 146 is provided within the core 136, and includes a threaded opening which threadably engages with the locking bolt 142 for the purpose of co-acting against the inner surface 150 of the supply roll core 136 when the appropriate adjustment is made along the slot 140 of the clamping bar 138. The friction cylinder 146 is provided for the purpose of causing a drag on the supply roll as the hang strip 16 is pulled from the supply roll upon the advancing action of the indexing means 24 as discussed previously. The providing of the drag in the supply roll is an important feature to the invention in that the drag feature prevents the accumulated weight of items 8,8 which are attached to the hang strip at the article attaching station 13 from pulling the strip beyond the indexing station before a controlled indexing operation occurs.

Figure 16:
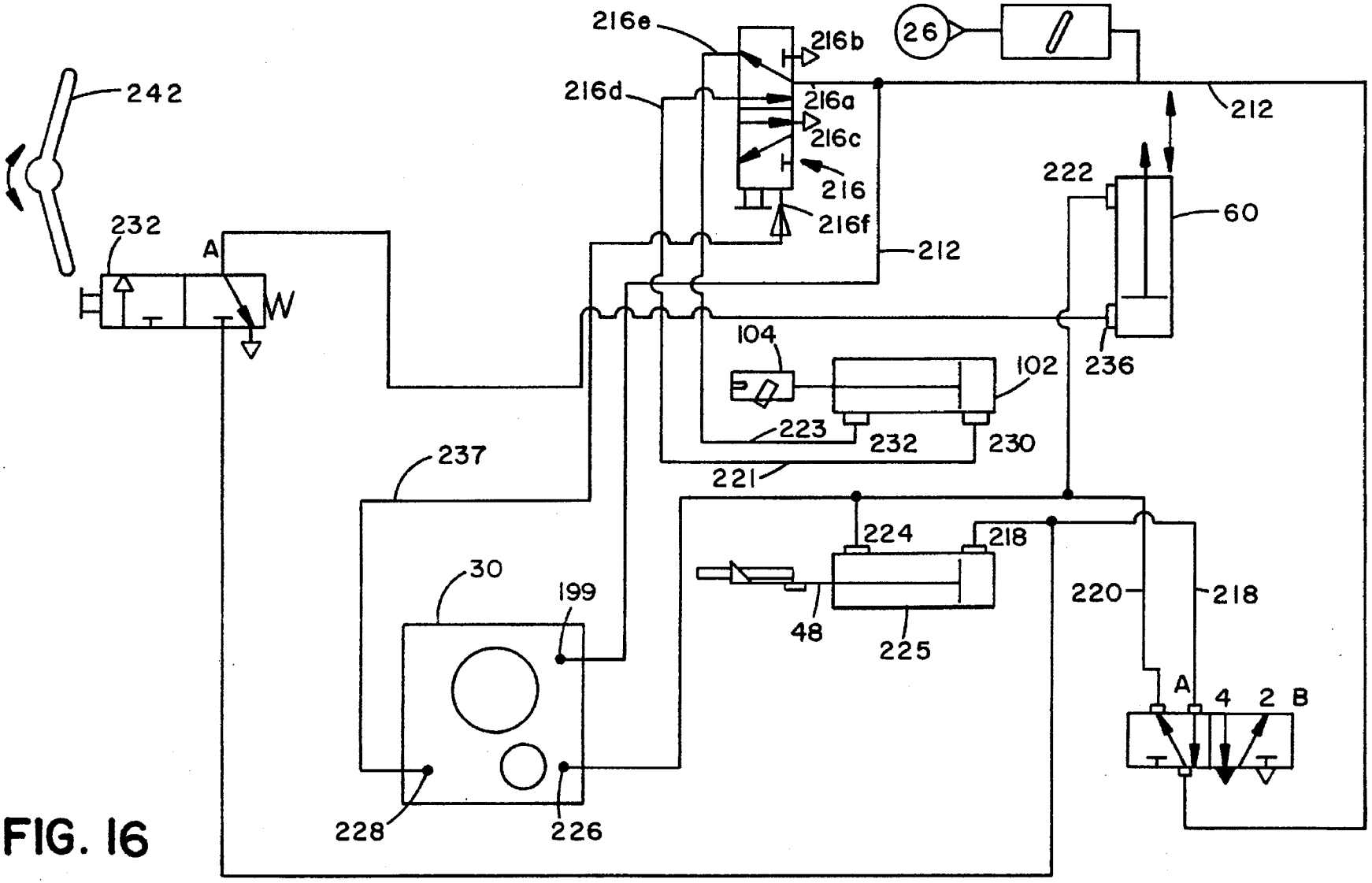
FIG. 16 is a schematic drawing of the circuitry controls of the invention.

Referring now to FIG. 16, and in particular to the control system responsible for the controlled indexing of the hang strip 16, it should be seen that the control system is responsive to a depression of the foot pedal 32 to advance the hang strip 16 an incremental distance corresponding to the distance between locations S,S on the hang strip. The system further includes the counting means 30 for counting the number of successive advances inputted by the user to the foot pedal and for automatically effecting cutting of the hang strip when a given number of indexing operations has occurred thereby forming strips of uniformly numbered items 8,8 hung thereon. The system is connected to a pressurized air source 26, the introduction of which is controlled through a main on/off switch 210 having a feedline 212 which introduces pressurized air to the system. The system controls, in addition to the foot pedal 32, include a pneumatic counter 30, a valve switch 216 and an air limit switch 232 interconnected with one another through appropriate fluid lines to effect the controlled operation of the system. The pressurized air feedlines 212,212 connect the pressurized air source directly to each of the counter means 30, at inlet 199, the foot pedal 32, and the air valve switch 216.

Connected to the foot pedal 32, is a first and a second energizing line, 218 and 220, respectively, which connect to the particular component parts of the system in the following manner. The line 220 connects to the retraction port 222 of the vertical actuator 60 and to the retraction port 224 of the horizontal actuator 225 and then to the inlet 226 of the counter means 30. The line 218 connects in parallel with the expansion inlet 228 of the horizontal actuator 225 and to an inlet port 230 of the limit switch 232. The outlet of the limit switch 218 indicated at 234 in turn is connected to an expansion inlet 236 of the vertical actuator 60. The limit switch 218 is normally biassed in a closed to flow condition and includes a mechanical arm 242 which is disposed along the path of travel of the piston rod 48 so as to be moved by it when the rod is extended. The valve switch 216 includes a pressurized air inlet port **216*a* which is connected to the pressurized air supply line 212, a pair of vent ports 216*b* and 216*c* disposed adjacent the port 216*a*, a first working line port 216*d* and a second working line port 216*e* each respectively connected to an expansion inlet 230 and a retraction inlet 232 of the cutting means actuator 102 through lines 221 and 223. The switch valve 216 further includes a signal port 216*f* which is fluidically connected to the output port 228 of the counter means 30 by the line 237. The line 237 momentarily introduces air at the port 216*f* of the valve switch 216 so that the valve is controllably moved against an internal spring member 213 in order to cause momentary reverse energization of reciprocated cutting of the web by the introduction of pressurized air to the horizontal actuator 102. The valve actuator 216 is one made by FESTO and sold commercially under serial number F102, part number VL-5-3.3, the limit switch is also made by FESTO and sold under serial number F706 and part number RW-3-MS and the counter means 30** is a pneumatic counter sold by FESTO under Serial Number 5040 and part number P-Z-VSEAUTD4.

In operation, the pressurized air supply line 220 feeds the foot pedal 32, and in its normal, undepressed condition, the foot pedal 32 pressurizes the line 220 so as to reverse bias the vertical actuator 60 in a down condition and the horizontal actuator 225 in a retracted condition by introducing pressurized fluid to inlets 222 and 224 of these members, respectively. When the pedal 32 is depressed the line 220 is open to atmosphere, and line 218 becomes energized thereby introducing pressurized air into the expansion chamber of the horizontal actuator 225 through the inlet 228, while simultaneously introducing pressurized air to the inlet 230 of the limit switch 232. With the extension of the rod 48 of the actuator 225, the mechanical arm 242 of the switch 232 is moved and causes pressurized air to communicate through the limit valve from the inlet 230 to the outlet 234 so as to introduce the communicated pressurized air to the expansion inlet 236 of the vertical actuator 60. The switch is normally biased in a closed condition so that upon retraction of the horizontal actuator 225, the limit switch 232 moves to a closed condition thereby cutting off the flow of air to the expansion inlet 236.

Controlled cutting of the hang strip 16 is effected by a signal generated by the counter means 30 from the output port 228 of the counter means 30 to the signal port 216*f* of the valve switch 216. The signal is only generated after a given number indexing operations have occurred. This is accomplished by the counter means 30 which is provided with a means for allowing setting of a given number of indexing operations, and then counting these operations until the given number is reached. This is done by sensing at input port 226 the on/off cycles of pressurized air which are applied and not applied to line 220 by the foot pedal 32. In this way, the hang strip may be cut transversely of its length concomitantly with the loading of a given number of items 8.8 onto the strip.

By the foregoing, an apparatus for automatically attaching items to a hang strip is disclosed. However, it should be understood that numerous modifications and substitutions may be had without departing for the spirit of the invention. For example, while the control circuit is shown in the preferred embodiment is driven by pressurized air, it is nonetheless within the purview of the invention to provide a similar control system which is electronically controlled.

Accordingly, the invention has been described by way of illustration rather than limitation.

Having thus described the invention, what is claimed is:

1. An apparatus for releasably attaching items to a hang strip comprising:

(a) a base;

(b) an article attaching station located on said base;

(c) a means for providing a supply of hang strip material for advancement relative to said base from said supply of hang strip material to said article attaching station;

(d) an indexing station provided on said base for advancing a hang strip in discreet incremental sections from said means for providing a supply of hang strip material to said article attaching station;

(e) said indexing station including an indexing means having means for engaging formed cut shapes in a hang strip and advancing a hang strip through engagement with an involved one of the formed cut shapes to a location generally adjacent said article attaching station;

(f) means associated with said article attaching station for causing selected ones of said formed cut shapes which are otherwise closed to be opened;

(g) means for cutting a hang strip transversely of its length and disposed on said base; and (h) said indexing means includes at least one drive member which is driven between first and second positions disposed relative to said base, and the distance separating said first and second positions corresponding to the distance between consecutively ordered formed cut shapes taken along the length of the hang strip;

(i) and control means associated with each of said indexing means and said cutting means for causing actuation of said indexing means and actuation of said cutting means to effect indexing and cutting of a hang strip.

2. An apparatus as defined in claim 1 further characterized in that said base includes a cut-out formed therein and said indexing station and said article attaching station are located on a mounting block having a base support surface which is received within said cut-out formed in said base and secured thereto.

3. An apparatus as defined in claim 2 further characterized by said mounting block having a leading end and said article attaching station being located at the leading end of said mounting block and said mounting block at the leading end thereof having means for constraining and redirecting the path of said hang strip about a right angle turn from an otherwise horizontal path to one that is vertically directed.

4. An apparatus as defined in claim 3 further characterized by said article attaching station including a vertical actuator means for lifting a part of the formed cut shapes in the hang strip.

5. An apparatus as defined in claim 4 further characterized by said means for redirecting the path of said hang strip about the leading end of said mounting block further including a chamfered surface provided about the leading end of the mounting block.

6. An apparatus as defined in claim 5 further characterized in that disposed adjacent said leading end of said mounting block and intermediate of the means for redirecting the path of said hang strip is said vertical actuator means having a vertically movable member with a tip movable between a first lowered position and a second upper position with the lowered position being such that the tip of the vertically movable member is disposed below said base support surface of said mounting block, and wherein said second upper position is disposed substantially above said base support surface of said mounting block and is located coincidentally with a part of an involved one of said formed cutouts to move same to an opened condition.

7. An apparatus as defined in claim 6 further characterized by said indexing means includes an actuator having one end secured to said base and having a slidable rod having a free end movable between a first position corresponding to a retracted condition of said actuator and a second position corresponding to an extended condition of said actuator, and wherein said rod free end has a replaceable connecting member which mounts said at least one drive member to said actuator for movement between said first and second positions.

8. An apparatus as defined in claim 7 further characterized by a transversely extending pivot pin extending transversely of said at least one drive member and said mounting block including a slot extending in the direction of material flow, said at least one drive member having a tip of a given width and said slot in said mounting block being of a width for receiving the given width of said at least one drive member.

9. An apparatus as defined in claim 8 further characterized by said at least one drive member being rotatably biased about said pivot pin by a tensioning spring connected between said at least one drive member and the connecting member so as to cause the tip of said at least one drive member to extend upwardly beyond the mounting block support surface, and wherein said position of said tip of said at least one drive member being located above the support surface of said mounting block through the intermediary of a locating pin which contacts the undersurface of said mounting block and yieldably positions the at least one drive member thereat under the bias of said tensioning spring.

10. An apparatus as defined in claim 9 further characterized by said vertical actuator being connected to a vertically sliding plate journalled within a correspondingly sized elongate opening formed in said mounting block, and wherein said slide plate is adapted to engage a pair of finger tabs having tip ends punched from web material defining said formed cut shapes in said hang strip and directed along the path of travel of the hand strip with the tip ends thereof directed towards the article attaching station.

11. An apparatus as defined in claim 10 further characterized by said vertical actuator being connected to a sliding vertical member which is journalled in a correspondingly sized and shaped opening within said mounting block, and wherein said vertically movable member is adapted to engage a single tab finger interdigitated between a pair of tab fingers formed on the hang strip material as part of said formed cut shapes in said hang strip material.

12. An apparatus as defined in claim 4 further characterized by supply means including a supply roll having an inner surface mounted to a column vertically disposed on said base, said column having a transversely extending mounting bolt threaded at one end thereof and secured to said column at the other end thereof, a clamping bar having a through opening formed therein appropriately sized and shaped to receive the mounting bolt, a supply roll bearing member mounted to said column and bearing upon the inner surface of said supply roll, and tensioning means associated with said supply roll for tensioning the payout of the hang strip from the roll as said hang strip is advanced by said indexing means.

13. An apparatus as defined in claim 12 further characterized by said indexing means being controlled by a counting means which records the number of successive indexes that are effectuated by the indexing means and causes the cutting means to cut the hang strip transversely of its length at a point corresponding to where along the length of the strip a given number of indexing operations have occurred.

14. An apparatus as defined in claim 13 further characterized by said cutout formed in said base being sized to receive interchangeable mounting blocks each having a mounting plate disposed at the undersurface thereof and being capable of being connected to the undersurface of said base.

15. An apparatus as defined in claim 2 further characterized by said cutting means being mounted on said base adjacent said article attaching station and spans the cut-out formed in said base along a line of action; said mounting block having a transversely extending channel formed therein coinciding with the line of action followed by said cutting means across said cutout in said base and wherein said cutting means includes a laterally movable slide plate having a cutting blade depending therefrom and extending into said channel formed in the mounting block so as to transversely cut the material making up the hang strip as the slide block is moved from a first given position to a second end position, and back to the first given position.

16. An apparatus as defined in claim 1 further characterized in that said article attaching station includes a lifting means associated with said article attaching station for engaging a formed cut shape on the hang strip thereby opening the otherwise closed cut shapes.

17. An apparatus for releasably attaching items to a hang strip comprising:

(a) a base;

(b) an item attaching station including a lifting means;

(c) a supply means for providing a supply of hang strip material for advancement of said hang strip material relative to said base from said supply means to said item attaching station disposed remotely thereof;

(d) an indexing station provided on said base between said supply of said hang strip material and said item attaching station for advancing said hang strip in discrete incremental sections from said supply means to said item attaching station;

(e) sensing means associated with said indexing station for sensing the occurrence of an indexing operation and causing a lifting means associated with said item attaching station to be activated in response to articulation of said indexing station;

(f) cutting means disposed on said base for cutting the hang strip transversely of its length; and (g) control means associated with said sensing means and said indexing station for prompting said index means to advance the hang strip a given incremental distance and for counting the number of successive indexing operations occurring along the length of the hang strip and for causing the energization of said cutting means to cause said hang strip to be cut transversely of its length after a predetermined number of advances has occurred.

18. An apparatus is defining claim 17 further characterized by said control means including means defining a first condition in which an actuator means associated with said indexing means, a vertical actuator means associated with said item attaching station and an actuator associated with said cutting means and indexing means are energized so as to be moved to a retracted position thereof and defining a second condition in which the actuators of said vertical actuator means, said indexing means and said cutting means are caused to be moved to an extended condition corresponding to an advancement operation occurring at the indexing station.

19. An apparatus as defined in claim 18 further characterized by said means defining said first and second conditions including a limit switch associated with the vertical actuator and a multiple port switch receiving a signal by a counter means to cause reverse energization of the cutting means actuator in response to a given number of indexing operations occurring.

* * * * *